US006702648B1

(12) United States Patent
Avanzino et al.

(10) Patent No.: US 6,702,648 B1
(45) Date of Patent: Mar. 9, 2004

(54) USE OF SCATTEROMETRY/ REFLECTOMETRY TO MEASURE THIN FILM DELAMINATION DURING CMP

(75) Inventors: Steven C. Avanzino, Cupertino, CA (US); Bhanwar Singh, Morgan Hill, CA (US); Bharath Rangarajan, Santa Clara, CA (US); Ramkumar Subramanian, Sunnyvale, CA (US)

(73) Assignee: Advanced Micro Devices, Inc., Sunnyvale, CA (US)

( * ) Notice: Subject to any disclaimer, the term of this patent is extended or adjusted under 35 U.S.C. 154(b) by 0 days.

(21) Appl. No.: 10/277,559

(22) Filed: Oct. 22, 2002

(51) Int. Cl.[7] ..... B24B 49/00

(52) U.S. Cl. ..... 451/6; 451/5; 451/41; 451/287

(58) Field of Search ..... 451/6, 5, 8, 41, 451/63, 287, 288, 285; 156/345.13, 345.15, 345.16

(56) References Cited

U.S. PATENT DOCUMENTS 6,204,922 B1 * 3/2001 Chalmers ..... 356/630
6,476,921 B1 * 11/2002 Saka et al. ..... 356/630
6,515,493 B1 * 2/2003 Adams et al. ..... 324/716

* cited by examiner

*Primary Examiner*—Hadi Shakeri
(74) *Attorney, Agent, or Firm*—Amin & Turocy, LLP

(57) ABSTRACT

One aspect of the present invention relates to a system and method for examining a wafer for delamination in real time while polishing the wafer. The system comprises a polishing system programmed to planarize one or more film layers formed on at least a portion of a semiconductor wafer surface; a real-time metrology system coupled to the polishing system such that the metrology system examines the layers as they are planarized; and one or more delamination sensors, wherein at least a portion of each sensor is integrated into the polishing system in order to provide data to the metrology system and wherein the sensor comprises at least one optical element to detect delamination during polishing. The method involves polishing at least a portion of an uppermost film layer and examining at least a portion of a layer underlying the uppermost film layer for delamination as the uppermost layer is being polished.

21 Claims, 8 Drawing Sheets

USE OF SCATTEROMETRY/ REFLECTOMETRY TO MEASURE THIN FILM DELAMINATION DURING CMP

TECHNICAL FIELD

The present invention generally relates to processing a semiconductor substrate. In particular, the present invention relates to inspecting wafer surfaces during polishing for indications of delamination.

BACKGROUND ART

Many modem integrated circuits generally include multiple layers of metallic or conductive wiring surrounded and covered by insulating or dielectric layers. Maintaining the utmost accuracy in the deposition of these layers and subsequent formation of conductive and nonconductive features is critical in achieving smaller and smaller device dimensions and higher packing densities using conventional lithographic processes.

In general, lithography refers to processes for pattern transfer between various media. It is a technique used for integrated circuit fabrication in which a silicon slice, the wafer, is coated uniformly with a radiation-sensitive film, the resist, and an exposing source (such as optical light, X-rays, or an electron beam) illuminates selected areas of the surface through an intervening master template, the photoresist mask, for a particular pattern. The lithographic coating is generally a radiation-sensitized coating suitable for receiving a projected image of the subject pattern. Once the image is projected, it is indelibly formed in the coating. The projected image may be either a negative or a positive of the subject pattern. Exposure of the coating through the photoresist mask causes a chemical transformation in the exposed areas of the coating thereby making the image area either more or less soluble (depending on the coating) in a particular solvent developer. The more soluble areas are removed in the developing process to leave the pattern image in the coating as less soluble polymer.

As the trend of decreasing the size of devices on chips and of increasing the size of a silicon die simultaneously continues, constant improvements are required in order to satisfy and exceed the demands of the marketplace. For example, in the area of interconnect structures, low dielectric constant (k) materials are beginning to replace higher dielectric constant materials due to the many benefits of low k materials. Since finer conductors are being placed ever closer together, lower k materials tend to be more desirable in order to minimize circuit impedance and decrease the on-chip power dissipation.

However, because lower k materials are typically weaker and more porous than their higher k counterparts, they may present problems during fabrication such as delamination or peeling of the thin film layers. Delamination may result from structural collapse of the film from excessive down-force, and from damage started by macroscratches.

Thus, there is an unmet need to detect for delamination in thin films in order to decrease device flaws and performance deficiencies and to increase overall product yield.

SUMMARY OF THE INVENTION

The following presents a simplified summary of the invention in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

The present invention provides for a system and method of examining a wafer during a polish process for delamination or indications thereof. In particular, the system and method involve detecting film delamination events occurring during chemical mechanical polishing (CMP) processing of interconnect structures. Furthermore, the present invention may be performed in real time, thus allowing for an immediate reaction or response by a user or by the polishing system/process to an occurrence of film delamination on the wafer.

This real time examination for delamination may be accomplished in part by employing a metrology system and one or more delamination sensors such that the metrology system, delamination sensors and the CMP system operate cooperatively with one another. For example, the metrology system includes light sensitive measuring instruments. A change in reflected light intensity may be indicative of a delaminated film area on the wafer. A change in scattered light intensities may be indicative of delamination within repetitive line patterns in a grating. The delamination sensors comprise optical elements to facilitate transmitting light directed to and reflected from the wafer. Because the delamination sensors are operatively connected to the metrology system, the data can be communicated from the sensors and to the metrology system. The metrology system may further process and/or analyze the data generated from the wafer in order to determine whether delamination has been detected.

The CMP system may be signaled to temporarily or permanently suspend itself until further instructions are transmitted thereto to indicate a resumption of polishing. Thus, the present invention provides for real time delamination examination and detection as well as a real time response to delamination. Furthermore, one or more polishing components may be adjusted according to the detected delamination. As a result, delamination on the wafer may be mitigated and/or repaired, and delamination may be mitigated with respect to future wafers and/or future polishing processes.

One aspect of the present invention relates to a system for real-time examination of delamination during a polishing process. The system includes a polishing system programmed to planarize one or more film layers formed on at least a portion of a semiconductor wafer surface; a real-time metrology system operatively coupled to the polishing system such that the metrology system examines the layers as they are planarized; and one or more delamination sensors operatively connected to the polishing system and employed in conjunction with the polishing system, wherein at least a portion of each sensor is integrated into the polishing system in order to provide data to the real time metrology system and wherein the sensor comprises at least one optical clement to detect delamination during polishing.

Another aspect of the present invention relates to a method for real-time examination of delamination during a polishing process. The method involves providing a wafer having one or more film layers formed thereon such that at least an uppermost film layer is prepared to be polished, the uppermost film layer being a copper layer; polishing at least the uppermost film layer; examining at least a portion of a film layer immediately underlying the uppermost layer for delamination as the uppermost layer is being polished; and determining whether to suspend the polishing process according to data generated from at least the immediately underlying film layer. In an alternative application, the low-k material might be present as a deeply underlying film layer, and the deeply underlying low-k material may be subject to delamination as the overlying film layers are polished.

Yet another aspect of the present invention relates to a system for real-time examination of delamination during a polishing process. The system includes a means for providing a wafer having one or more film layers formed thereon such that at least an uppermost film layer is prepared to be polished, the uppermost film layer being a low dielectric material; a means for polishing at least the uppermost film layer; a means for examining at least a portion of the uppermost film layer for delamination as it is being polished; and a means for determining whether to suspend the polishing process according to data generated from at least the uppermost film layer.

DISCLOSURE OF INVENTION

Figure 1:
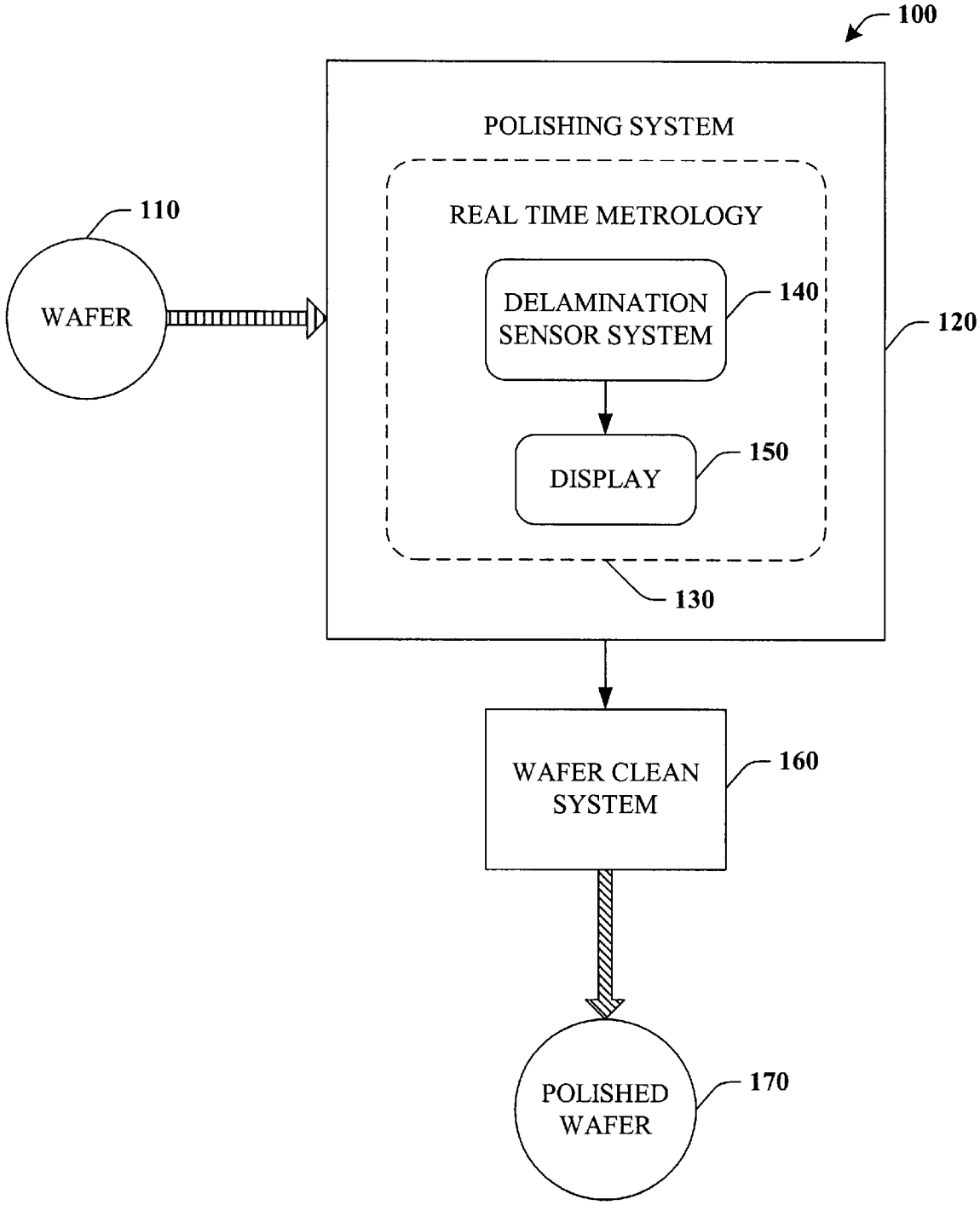
FIG. 1 illustrates a high-level schematic block diagram of a system for examining a wafer surface as it is being polished for delamination in accordance with one aspect of the present invention.

The present invention involves a system and method for examining a wafer for delamination as it is being polished. In particular, the invention provides for a system and method for detecting film delamination events occurring during a chemical mechanical polishing process (CMP) of interconnect structures. Moreover, at least a portion of a film layer underlying a wafer surface (which is being polished) may be examined for delamination and/or one or more surface effects associated with delamination. Unlike conventional systems, the present invention may occur in real time. That is, as an area of the wafer is being polished, an area underlying the polished area may be examined, inspected and/or screened for delamination such that data generated from such examination may be communicated in real time to effect the polishing of that area of the wafer or of the whole wafer, in general.

This may be accomplished in part by employing one or more delamination sensors integrated within one or more polishing units (e.g., polisher) as well as a real-time metrology system. The real-time metrology system may be operatively coupled to the delamination sensors such that data and/or information may be communicated between the metrology system and the delamination sensors in real time in order to immediately affect a polishing process.

As mentioned above, the delamination sensors can be integrated or built into the polisher or polishing unit such that the sensors can detect delamination or indications thereof while the polishing process is taking place on the wafer. Each sensor may contain optical elements and/or fibers for transmitting data from and to the sensor, from and to the wafer, and from and to the metrology system. Alternatively, a first sensor in the polishing unit may be used for communicating data to the wafer, for example; and a second sensor in the polishing unit may be used for communicating data from the wafer, for example. Other configurations of transferring data from the wafer, to the polishing process, and vice versa are contemplated to fall within the scope of the present invention.

The metrology system includes at least one of a scatterometer and an optical reflectometer in order to facilitate obtaining and/or generating data corresponding to the wafer that is being polished. The scatterometer and/or reflectometer direct an incident beam of light through the one or more delamination sensors via the optical elements/fibers such that the incident light contacts the wafer surface. Likewise, the light is reflected from the wafer surface and captured by the one or more delamination sensors. The optical elements/fibers facilitate the transmission of the reflected light data from the wafer to the metrology system for further processing and analysis.

Upon analysis of the light data, a finding of delamination and/or indications thereof on the wafer surface may be determined by various factors. For example, a change in a reflected intensity of the incident light may indicate an area of delaminated film on the wafer. This change in reflected intensity can correspond to a bubbled area on the wafer surface or particular portion of the wafer surface which is missing or peeled away. Bubbled, missing, and/or peeling areas of the wafer surface can be indications of delamination. Alternatively, or in addition, detection may also be possible by ascertaining that a change in scattered light intensities has occurred with respect to repetitive line patterns in a grating.

When delamination is detected on at least a portion of the wafer underlying a surface that is being polished, a polish controller may signal the polishing units to suspend operation in order to resolve the delamination error on the wafer before the wafer proceeds to further processing. Moreover, discrete delamination events may be detected by examining an entire wafer surface or at least a portion thereof such that delamination occurring at about 1 micrometer in dimension may be found in real time. Thus, the polishing process may be suspended or terminated in order to resolve the delamination and in order to mitigate future delamination on future wafers undergoing a similar CMP process.

The present invention will now be described with respect to FIGS. 1–10 as follows below.

FIG. 1 illustrates a high-level schematic block diagram of a system 100 for detecting delamination or indications thereof which may occur while polishing a wafer 110. The system includes a polishing system 120 such as a CMP system to facilitate planarizing at least a portion of a surface of the wafer 110. For example, the surface of one or more interconnect structures formed in the wafer 110 may require polishing in order to substantially complete formation of the interconnect device.

The system 100 also includes a real-time metrology system 130 which may be integrated and/or aligned with the polishing system 120. The metrology system 130 comprises a delamination sensor system 140 which assists in the detection of delamination as it may arise while the wafer 110 is being polished. The delamination sensor system 140 detects delamination or indications thereof in real time and may communicate this information to the polishing system 120 in real time as well. Thus, the polishing system 120 may react immediately during the polishing process in order to mitigate the delamination event detected on the wafer 110. For instance, the polishing process may suspend its polishing components (not shown) in order to repair the delamination on the wafer. The polishing process also may re-assess its polishing settings if necessary to mitigate delamination from recurring.

In addition, the detected delamination may be graphically viewed on a display 150 such that a user may visualize pinpointed locations of the delamination as found on the wafer 110. This visual display of the delamination may permit further adjustments or modifications to the polishing system 120 in order to reduce future delamination events.

Once the wafer 110 has been sufficiently polished according to the desired specification, the wafer 110 may proceed to a wafer cleaning system 160 in order to remove excess debris from the wafer 110 resulting from the polishing process. Finally, a polished wafer 170 exits the system 100 and can continue to additional processing stages.

Figure 2:
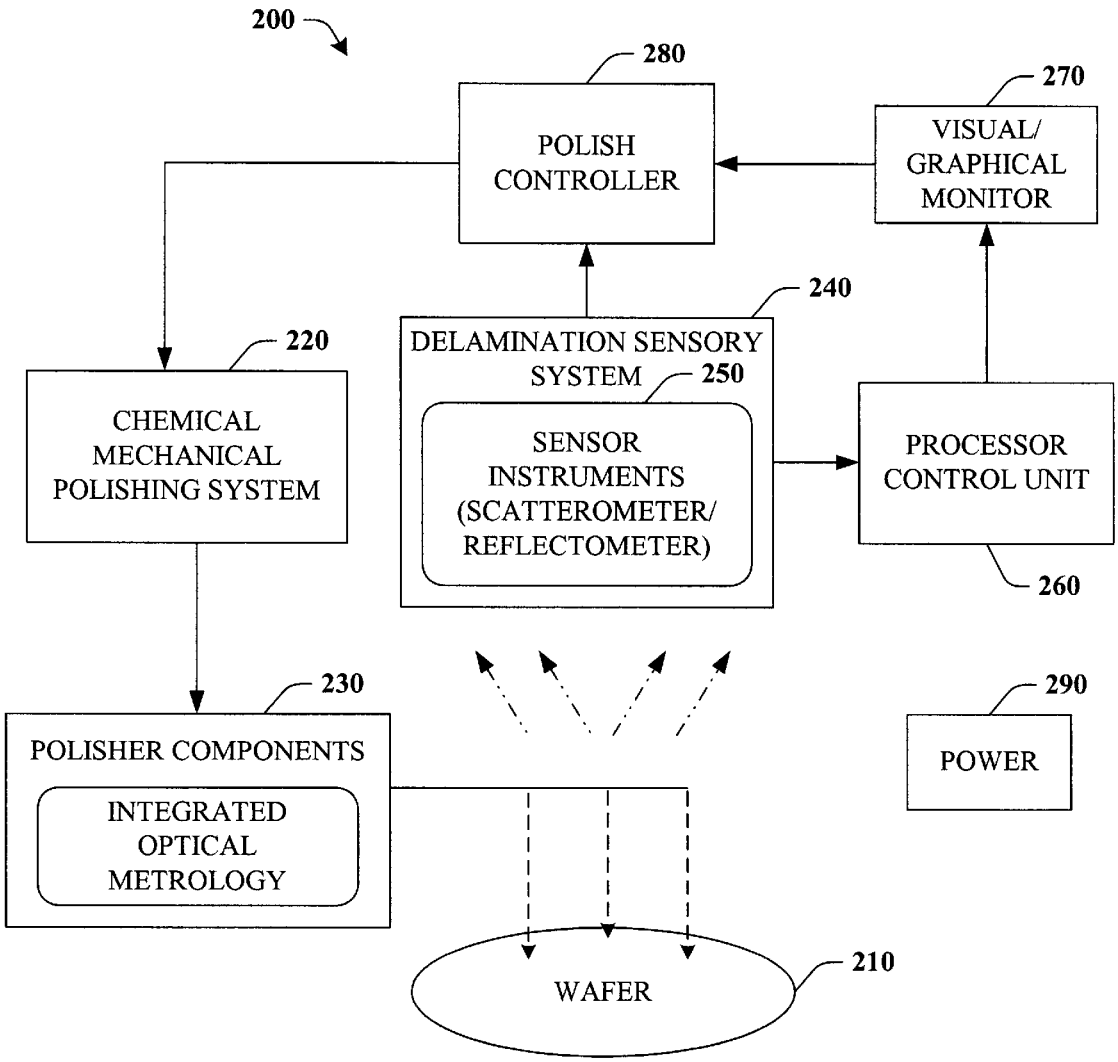
FIG. 2 illustrates a schematic block diagram of a system for examining a wafer surface in real time as it is being polished for delamination in accordance with one aspect of the present invention.

FIG. 2 illustrates a schematic block diagram of a system 200 for detecting delamination events in real time during CMP processing of a wafer 210. The system 200 includes a chemical mechanical polishing system 220 which has been activated to polish at least a portion of the wafer 210 via one or more polisher components 230. Examples of polisher components are polisher units (e.g., see FIG. 3 below), slurry, temperature, removal rate, polishing speed, direction of polishing, and the like.

The wafer 210 may be similar to the wafer 110 described above with respect to FIG. 1 in that it may have interconnect structures partially formed thereon which require smoothing and/or planarization via polishing in order to complete fabrication of the structures. As the wafer 210 is polished using one or more of the polisher components 230, the areas on the wafer being polished may be monitored for delamination. This may be accomplished in part by employing integrated optical metrology together with one or more of the polisher components 230. The optical metrology comprises aspects of metrology instrumentation such as a scatterometer and/or reflectometer and an arrangement of optical elements and/or fibers as the means for data transmission between the Instrumentation and the wafer. The optical metrology is further described in FIG. 3 below.

Moreover, as the wafer 210 is polished a delamination sensory system 240 may be employed to detect delamination occurring on the wafer during the polishing process in real time. The delamination sensory system 240 includes sensor instruments 250 such as a scatterometer and/or reflectometer. When using the scatterometer, for example, light is directed at the wafer 210 (via optical elements within a polisher unit) and reflected from the wafer 210. The reflected light may be captured by the optical elements within the polisher unit and transmitted back to the scatterometer.

The reflected light data may be communicated to a processor control unit 260 for further processing and analysis in order to determine whether delamination has been detected, where on the wafer it has been detected, and/or whether the polishing process is to be suspended in order to resolve the delamination found on the wafer 210. Because the above described system 200 is operating in real-time, the polishing process continues until either instructions are received to suspend and/or pre-maturely terminate the process or the process ends as prescribed according to programmed polishing length parameters.

Still referring to FIG. 2, the processor control unit 260 generates results from the data obtained by the delamination sensory system 240 and transmits this data to a visual graphical monitor 270 for display to a user. The data may be in a format such that areas of delamination can be visually pointed out on the wafer 210 with respect to the location of the delamination and even apparent size of the delaminated areas. An exemplary format for the data is shown and described in further detail in FIG. 9 below.

The data associated with the areas of delamination may also be transmitted to a polish controller 280. The polish controller 280 is operatively coupled to the delamination sensory system 240 as well as to the processor control unit 260 (by way of the monitor 270) in order to receive data which has been analyzed and/or results from analysis by either the delamination sensory system 240 or the processor control unit 260, or both. The polish controller 280 is also connected to the chemical mechanical polishing system 220 such that it may direct the polishing system 220 to suspend its operation in order to repair any detected delamination on the wafer 210.

When the controller 280 instructs the polishing system 220 as such, the polishing system 220 reacts accordingly by suspending and/or adjusting the operation of the one or more polisher components 230 in a suitable manner. Moreover, the system 200 facilitates reducing and repairing delamination on the current wafer 210 as well as reducing delamination from occurring on future wafers.

Alternatively, the wafer may be examined for delamination following polishing and that information may be processed and analyzed in order to modify one or more aspects of the polishing system 220 in order to mitigate delamination on future wafers. That is, feed back and feed forward control of the polishing system may be implemented in order to effect subsequent wafers being polished by the polishing system 220.

A power supply 290 suitable to carry out the present invention may also be utilized. Examples of such include a battery containing sufficient energy to drive the system and processes described herein without undue interruption.

Figure 3:
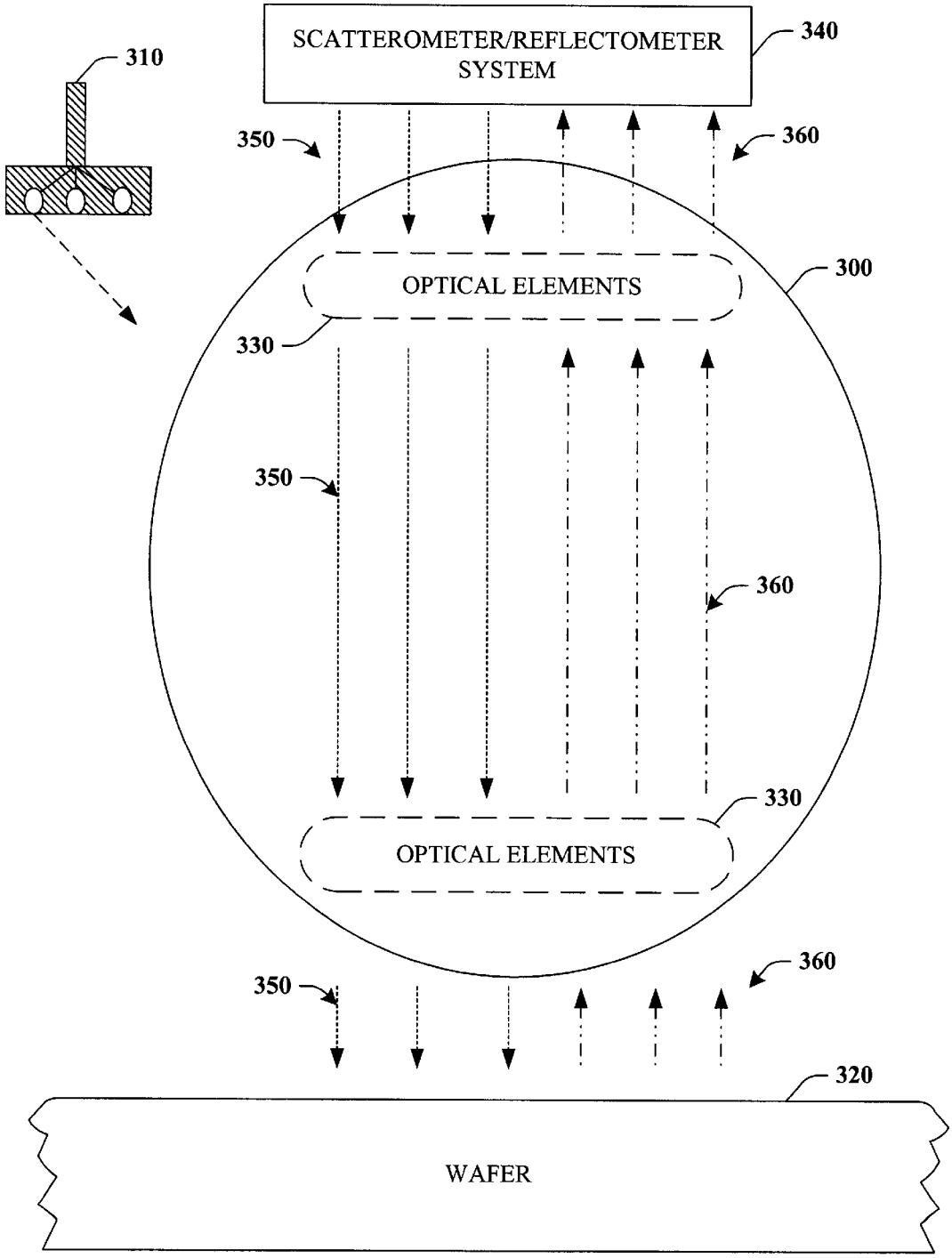
FIG. 3 illustrates a schematic block diagram of a delamination sensor system in accordance with one aspect of the present invention.

FIG. 3 depicts a schematic cross-sectional view of an exemplary delamination sensor 300, one or more of which may be contained within a polisher unit 310 for detecting delamination while the unit 310 polishes a wafer surface 320. The delamination sensor comprises one or more optical elements 330 which can transmit light, sound, as well other types of numeric and alphanumeric information as desired by the user.

According to the present invention, a scatterometer or optical reflectometer system 340 such as that described above in FIG. 2 may be employed to facilitate the detection of delamination on the wafer 320. For example, a beam of incident light 350 from a light source(not shown) within the scatterometer or reflectometer system 340 can be directed toward the wafer surface 320 by way of the one or more optical elements 330. That is, the light 350 is transmitted from the light source in the system 340 through the optical elements 330 and then to the wafer surface 320. Light reflected 360 from the wafer surface 320 through the one or more optical elements 330 and then to the scatterometer or reflectometer system 340. Data corresponding to the incident 350 and reflected light 360 may then be communicated to the processor control unit 260 (FIG. 2) for further processing and analysis in order to determine in real time whether delamination is detected on the wafer surface 320.

It should be appreciated that the delamination sensor 300 may comprise a plurality of optical elements 330 such as at least a first and second optical element wherein each of the first and the second optical elements are individually designated to transmit light, data, and the like in one direction (e.g., either to the wafer or from the wafer).

Alternatively, or in addition, the individual optical elements 330 may be designated to transmit particular types of information—such as only light or only data, for example. The plurality of optical elements 330 may also be grouped or clustered by the type of information to be transmitted by the optical elements. For instance, more than one optical element may be clustered as group A and designated to transmit light only to and from the wafer. However, a group B of optical elements 330 may be programmed to only transmit numerical data between the polisher unit 310 and the polishing system 220 (FIG. 2). In addition, it should also be understood that the optical elements 330 depicted in FIG. 3 may be arranged as elongated or fibrous elements spanning the distance between top and bottom ends of the sensor 300, for example, and such arrangement as well as other suitable arrangements are contemplated to fall within the scope of the present invention.

Figure 4:
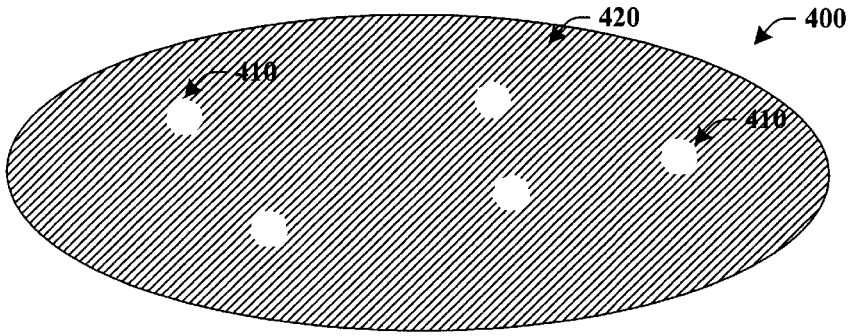
FIG. 4 illustrates a top view of a schematic wafer surface demonstrating delamination in accordance with one aspect of the present invention.

FIG. 4 illustrates a top view of an exemplary wafer 400 demonstrating delamination 410 and/or indications thereof. Bubbled, missing, and/or peeling areas of a wafer surface 420 may indicate one or more delamination events on the wafer 400.

Figure 5:
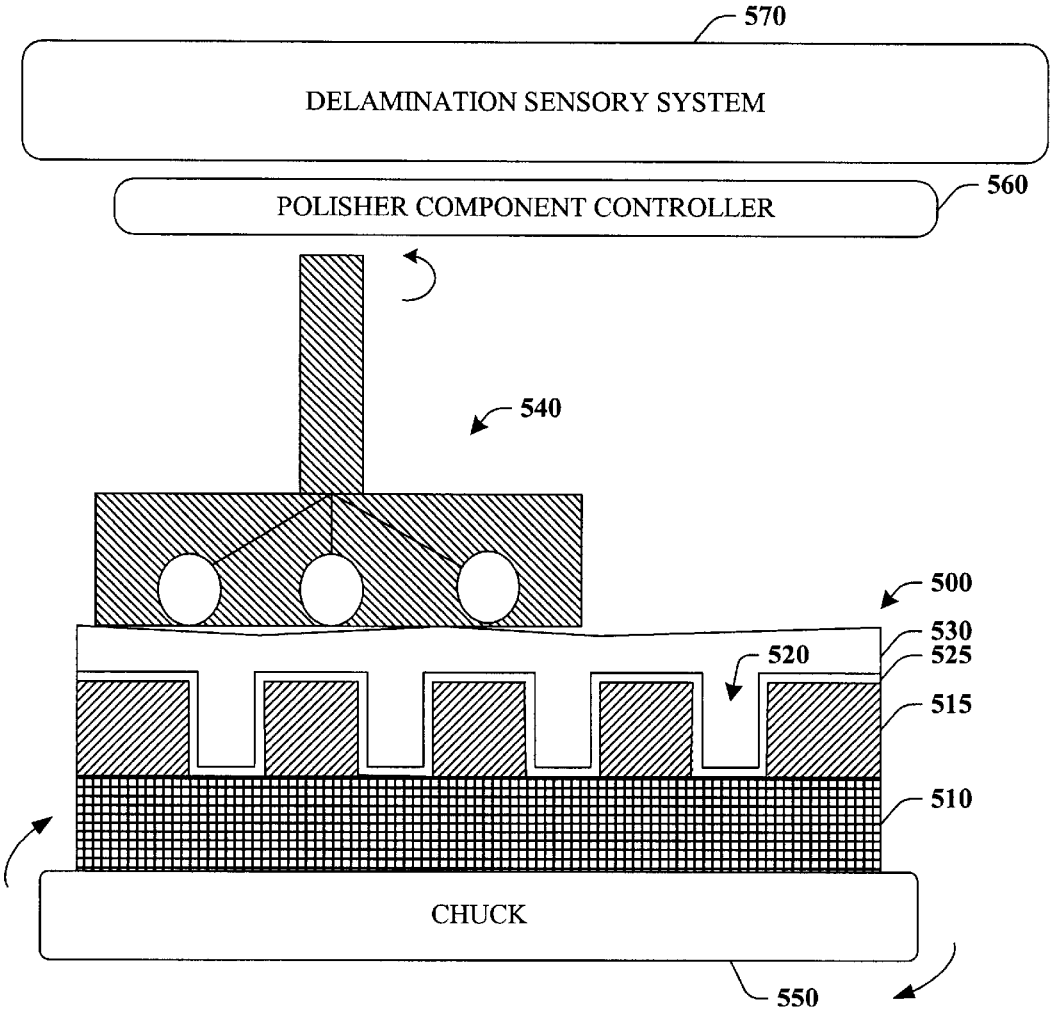
FIG. 5 illustrates a cross-sectional view of a wafer undergoing a polishing process in accordance with one aspect of the present invention.
Figure 7:
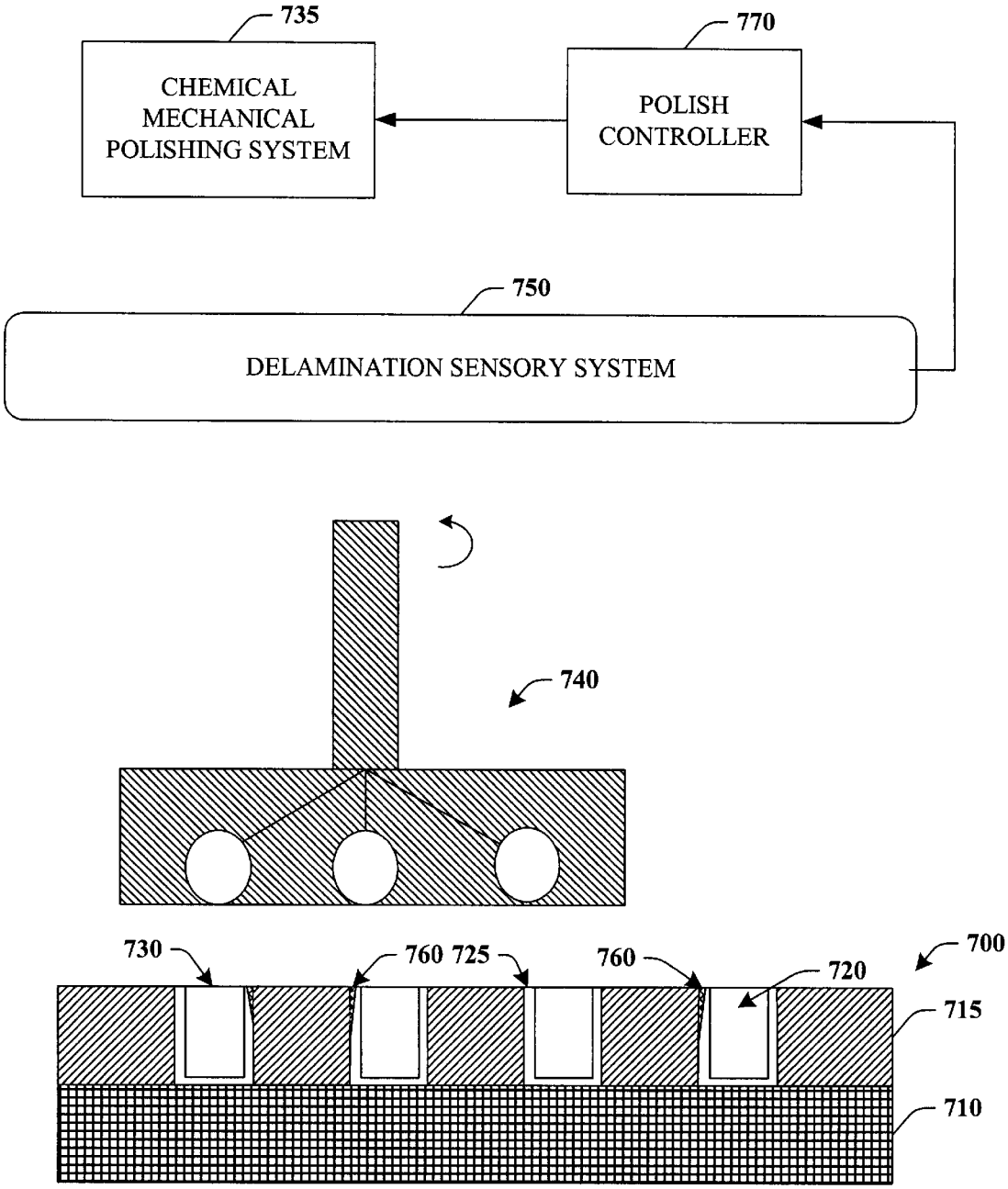
FIG. 7 illustrates a cross-sectional view of a wafer surface being examined for delamination in real time in accordance with one aspect of the present invention.

Turning to FIG. 5, a cross-sectional view of a wafer structure 500 undergoing CMP processing in accordance with an aspect of the present invention is shown. The wafer structure 500 includes a substrate 510, a low dielectric constant (k) material 515 and one or more trenches 520 etched therein. A barrier layer 525 is formed over the low dielectric constant (k) material 515 such that it is conformal to the trench structures 520 in the low dielectric constant (k) material 515. Copper 530 is deposited over the barrier layer 525 such that the trenches 520 are filled with the copper 530. In order to substantially complete fabrication of interconnect structures on the wafer 500, the excess amount of copper and barrier layer are polished or planarized by way of a CMP polish process and system. As a result of the polishing, areas of the low dielectric constant (k) material 515 and portions of the barrier layer 525 and copper 530 should be exposed such as shown in FIG. 7 below.

One or more polish components operate cooperatively to carry out the CMP polish process. An example of a polish component is a polisher unit 540. It should be understood that the polisher unit 540 is not drawn to scale with respect to the wafer 500.

One or more polisher units 540 (see FIG. 3) may be employed in order to evenly and efficiently polish the necessary surface(s). The polisher units 540 may rotate in the same or opposite directions from one another. In addition, the wafer structure 500 is secured to a chuck 550 which may be rotated simultaneously with the polisher units 540 either in the same or opposite directions. It should be appreciated that if multiple platens 540 are used, the wafer is polished on one at a time. The wafer moves from platen to platen sequentially.

The CMP process and its related components may be regulated by a polisher component controller 560. As the polishing begins, a delamination sensory system 570 activates one or more delamination sensors incorporated at a bottom portion of the polisher unit 540 to continuously examine the surface being polished for delamination.

It should be appreciated that inspecting the underlying low dielectric constant material 515 for delamination may occur at any time during the polishing of the copper 530 and barrier layer 525. For example, during earlier stages of polishing, if the underlying low k dielectric material 515 delaminates and tears away from the wafer during the copper polish, then relatively large "copper-free" areas on the wafer may be observed and detected by the sensory system 570 with much of the copper film 530 still intact and adherent.

On the other hand, delamination may also be detected during later stages of polishing, in part, because the copper 530 is opaque. That is, delamination of the underlying low k dielectric film(s) 515 (e.g.. immediately below or deeply below the copper 530) may be observed optically when the copper 530 (and maybe some of the barrier layer 525) is removed near the end of the polish process.

Figure 6:
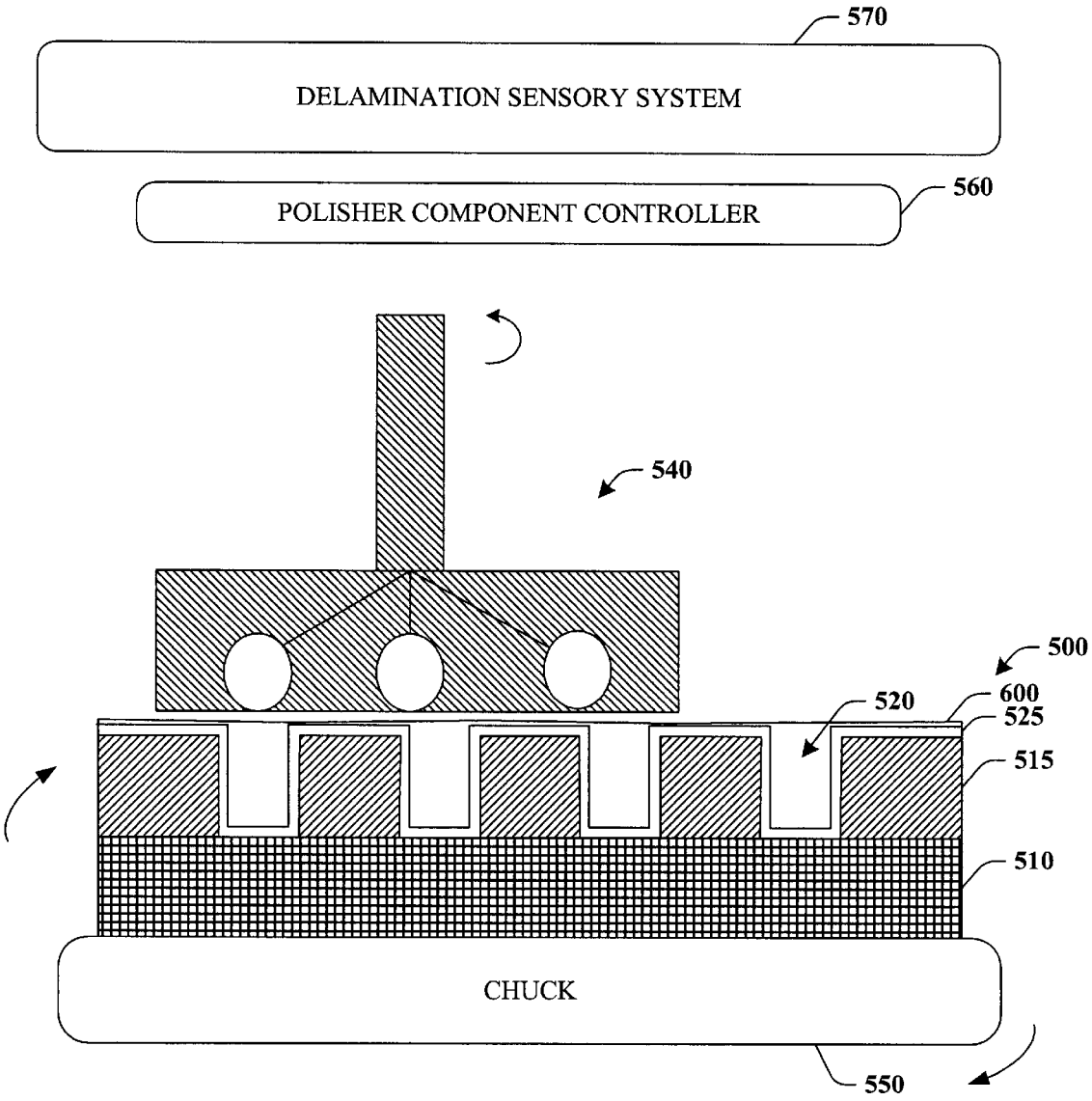
FIG. 6 illustrates a cross-sectional view of a wafer undergoing a polishing process in accordance with one aspect of the present invention.

According to FIG. 6, the wafer structure 500 as described above in FIG. 5 is progressing through the polishing process. This can be seen by the copper layer 530 (see FIG. 5) which has been polished down to result in a copper layer 600. The copper layer 600 continues to be polished until a desired amount of material 600 and 525 is removed from the wafer structure 500.

FIG. 7 illustrates a cross-sectional view of a wafer structure 700 which has been substantially polished. The wafer structure 700 includes a substrate 710, a low dielectric constant (k) material 715, and one or more interconnect structures 720 formed in the low dielectric constant (k) material 715. A conformal barrier layer 725 is formed in the structures 720 and a copper layer 730 has been deposited to fill the structures 720. After substantial polishing of portions of the copper layer 730 and the barrier layer 725 (as described in FIGS. 5 and 6), an amount of the barrier layer 725 as well as the copper layer 730 may still requiring polishing as implemented by the CMP system 735.

However, as shown in FIG. 7, polisher units 740 have been suspended due to an affirmative discovery of delamination 760 on, near, or at a surface of the wafer structure 700 by a delamination sensory system 750. The areas of delamination 760 may be detected by the delamination sensors incorporated within the polisher units 740. Because the polishing and examining for delamination occur coincidentally and/or concurrently in time and in real time, the polisher units 740 may receive immediate instruction to stop polishing for a time period as soon as the delamination is detected.

This real time detection and CMP system reaction may be accomplished in part by the delamination sensors transmitting light to and from the surface of the wafer to the delamination sensory system 750. The light can be processed and/or analyzed in order to determine whether delamination has occurred on the wafer. Once the determination is made, the information is communicated to a polish controller 770 for providing instructions or commands to the CMP system in accordance with the information (processed light data) it received. As such, the CMP system 735 has been suspended due to the detection of delamination 760.

Figure 8:
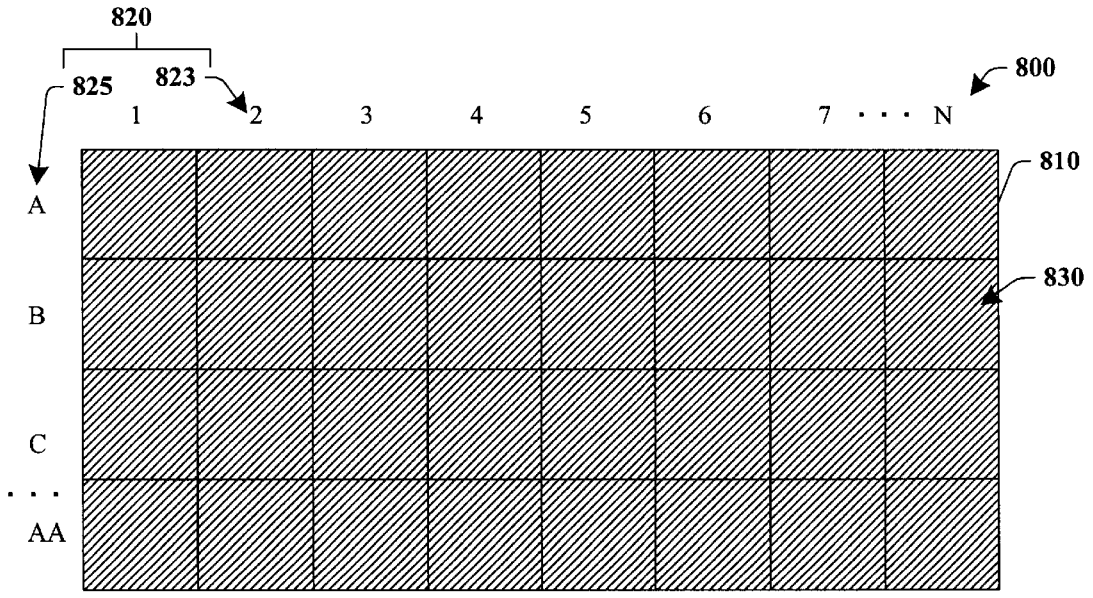
FIG. 8 illustrates a top view of schematic wafer divided in part into grid-like portions in accordance with one aspect of the present invention.

Turning now to FIG. 8. is a top view of a schematically drawn wafer 800 which has been divided into gridlike portions 810. The wafer 800 has been schematically diagrammed to have grid markers 820. The grid markers 820 comprises a column identifier 823 (e.g., 1 to N, where N is an integer greater than 1) and a row identifier 825 (e.g., single or multiple letter combinations such as A, AA, AAA, B, BB, etc.). The grid markers facilitate locating areas of delamination or specific points of delamination on the wafer surface 830.

Figure 9:
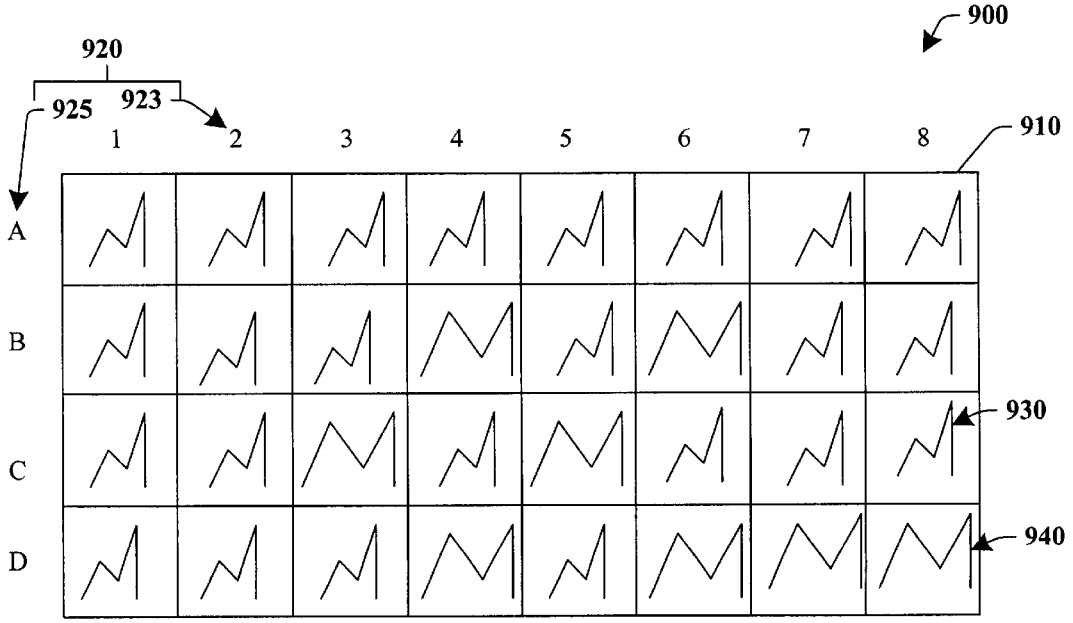
FIG. 9 illustrates a schematic exemplary display of data gathered from a wafer examined for delamination in accordance with one aspect of the present invention.

FIG. 9 illustrates an exemplary graphical display 900 of light data generated from a wafer which has been examined for delamination during polish processing. The graphical display 900 may correspond to the schematically diagrammed wafer 800 as described above in FIG. 8. The display may appear in grid like portions 910 such as having columns numbered 1 through 8 and rows numbered A through D. for example. Larger or smaller grid like portions 910 and the arrangement thereof are possible and such is contemplated to fall within the scope of the invention.

At least one portion 910 can comprise data relating to the light directed at and reflected from the wafer during polishing. Examples of such light data include but are not limited to signals 930 and 940. Signal 940 may indicate either a change in reflected intensity caused by a delaminated film area or a change in scattered light intensities caused by delamination within repetitive line patterns in a grating. In addition, signal 930 may represent non-delaminated film area on the wafer surface. The graphical display 900 may facilitate visualization of the areas of delamination on the wafer. Such information may assist a user in modifying the CMP system in order to mitigate delamination during future polish processes and/or on future wafers.

Figure 10:
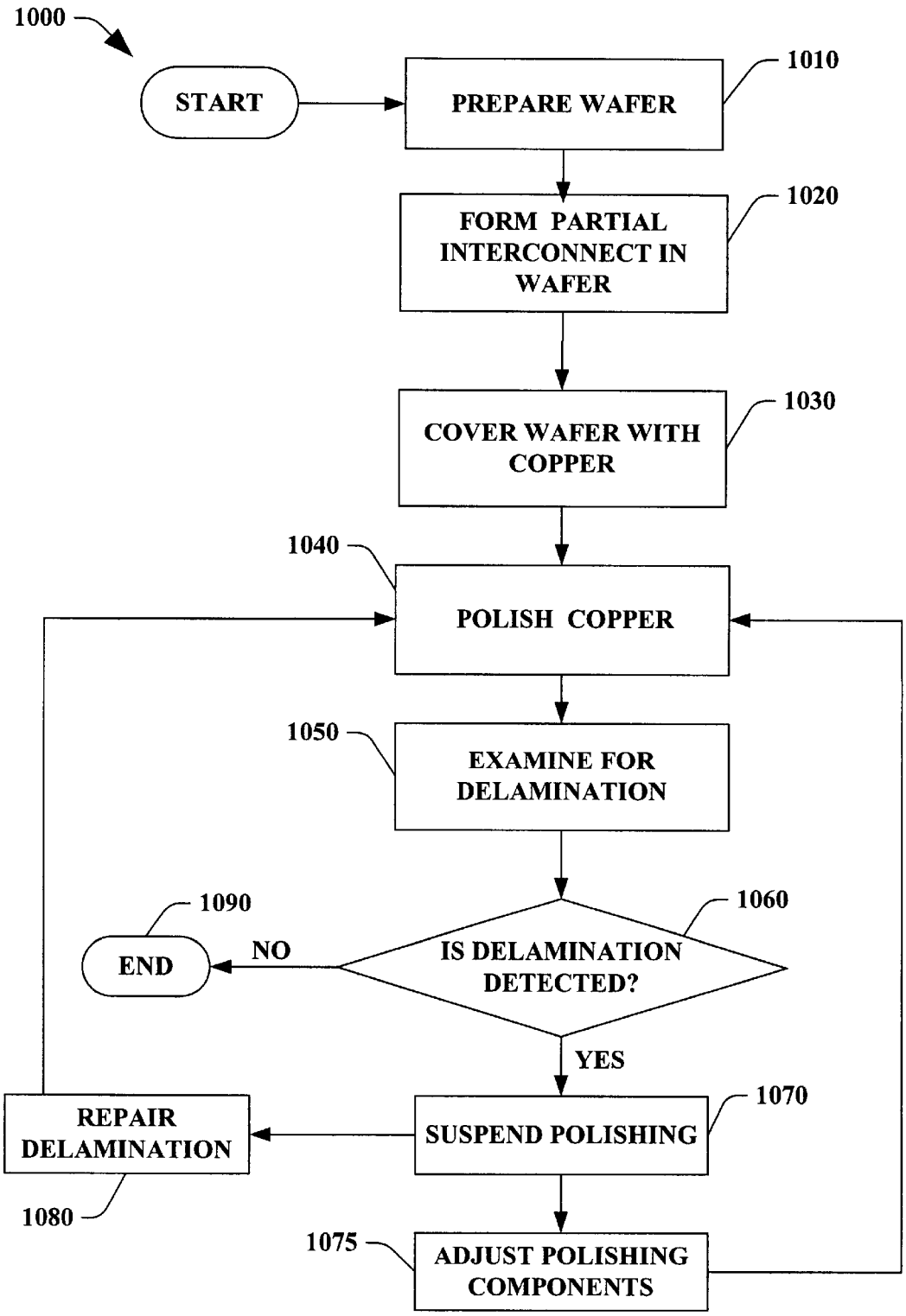
FIG. 10 illustrates a flow diagram of an exemplary method for examining a wafer surface during polishing for delamination effects in real time in accordance with one aspect of the present invention.

Referring now to FIG. 10, a flow diagram of an exemplary method 1000 for examining wafers for delamination while they are being polished in accordance with an aspect of the present invention is shown. The method 1000 involves preparing a wafer at 1010 for polishing. This may include forming and etching layers of material on the wafer in order to partially form interconnect structures at 1020. The interconnect structures include trenches. A blanket layer of low dielectric material may cover the wafer at 1030 in order to fill the trenches to facilitate forming the interconnect structures. Because an excess amount of copper is formed over the wafer, the excess can be removed in a controlled manner by a CMP process at 1040.

While the wafer is being polished, and in particular, at or near the end of the polishing operation when the opaque copper/barrier layer is removed and the transparent low k dielectric film is exposed, it may also be examined for occurrences of delamination or indications thereof at 1050. If delamination is detected at 1060, then the CMP process may be directed to suspend its operations at 1070. During the suspension of the CMP process, one or more polishing components may be adjusted in accordance with the detected delamination at 1075 in order to mitigate delamination during subsequent polishing or on future wafers. Alternatively, or in addition, the delamination may be repaired at 1080. Once the wafer is repaired and/or the components are adjusted, the polishing process may resumed at 1040.

However if no delamination is detected and the wafer surface is allowed to be substantially polished to a desired specification, the method may be terminated at 1090.

Although the invention has been shown and described with respect to several aspects, it is obvious that equivalent alterations and modifications will occur to others skilled in the art upon the reading and understanding of this specification and the annexed drawings. In particular regard to the various functions performed by the above described components (assemblies, devices, circuits, etc.), the terms (including any reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more other features of the other embodiments as may be desired and advantageous for any given or particular application.

What is claimed is:

1. A system for real-time examination of delamination during a polishing process comprising:

a polishing system programmed to planarize two or more film layers formed on at least a portion of a semiconductor wafer surface;

a real-time metrology system operatively coupled to the polishing system such that the metrology system examines the layers as they are planarized; and one or more delamination sensors operatively connected to the polishing system and employed in conjunction with the polishing system, wherein at least a portion of each sensor is integrated into the polishing system in order to provide data to the real time metrology system and wherein the sensor comprises at least one optical element to facilitate detecting delamination of at least a portion of a film underlying a surface that is being polished during polishing.

2. The system of claim 1, wherein the polishing system comprises one or more polishing components to facilitate and carry out the polishing process.

3. The system of claim 1, wherein the realtime metrology system comprises at least one of a scatterometer and a reflectometer to facilitate a visualization of the wafer surface being polished.

4. The system of claim 1, wherein the one or more delamination sensors is operatively connected to the real-time metrology system such that light supplied from the metrology system travels through at least one or more of the sensors via the optical element to contact the wafer surface.

5. The system of claim 1, wherein the one or more delamination sensors is operatively connected to the real-time metrology system such that light reflected from the wafer surface is transmitted through at least one or more of the sensors via the optical element back to the metrology system.

6. The system of claim 1, wherein the delamination sensor comprises a plurality of optical elements arranged in at least a group or a cluster to facilitate transmission of the data.

7. The system of claim 6, wherein the data is at least one of incident light, reflected light, numeric data, and alphanumeric data.

8. The system of claim 1, further comprising a processor control unit operatively connected to the one or more delamination sensors such that the processor control unit analyzes data gathered by the sensors to facilitate determining whether delamination is present on the wafer surface.

9. The system of claim 1, further comprising a monitor for real-time graphical displays corresponding to the data in order facilitate visualizing discrete areas on the wafer exhibiting delamination.

10. The system of claim 1, further comprising a polish controller coupled to at least the one or more delamination sensors such that the polish controller regulates whether the polishing system operates without interruption.

11. A method for real-time examination of delamination during a polishing process comprising:

providing a wafer having two or more film layers formed thereon such that at least an uppermost film layer is prepared to be polished, the uppermost film layer being a copper layer;

polishing at least the copper layer;

employing one or more delamination sensors to examine at least a portion of one or more film layers underlying the copper layer for delamination; and determining whether to suspend the polishing process according to data generated from the underlying film layers.

12. The method of claim 11, wherein polishing at least the uppermost layer is performed by a polishing system, the polishing system comprising one or more polishing components to facilitate and carry out the polishing process.

13. The method of claim 11, wherein examining at least a portion of the underlying film layers is performed by a real-time metrology system in order to facilitate the generation of data about the one or more underlying film layers, the metrology system comprising at least one of a scatterometer and reflectometer to facilitate a visualization of the wafer surface being polished.

14. The method of claim 13, wherein the one or more delamination sensors are operatively connected to at least one of the scatterometer and the reflectometer such that light supplied by at least one of the scatterometer and the reflectometer travels through at least one or more of the sensors to contact the wafer surface.

15. The method of claim 13, wherein the one or more delamination sensors is operatively connected to at least one of the scatterometer and the reflectometer such that light reflected from the wafer surface is transmitted through at least one or more of the sensors to at least one of the scatterometer and the reflectometer.

16. The method of claim 11, wherein determining whether to suspend the polishing process is performed by a processor control unit which analyzes data generated from the underlying film layers.

17. The method of claim 16, further comprising displaying data generated from at least the uppermost film layer and analyzed by the processor control unit.

18. The method of claim 11, further comprising regulating the polishing using a polish controller which is coupled to at least one or more polishing components associated with the polishing process.

19. The method of claim 11, wherein examining at least a portion of the one or more film layers underlying the cooper layer for delamination as the copper layer is being polished is performed in part by at least one optical element which facilitates transmission of data from and to the underlying film layer by way of the one or more delamination sensors.

20. The method of claim 11, wherein the polishing of the uppermost layer and the examining of the one or more underlying layers occur concurrently in time.

21. A system for real-time examination of delamination during a polishing process comprising:

means for providing a wafer having two or more film layers formed thereon such that at least an uppermost film layer is prepared to be polished, the uppermost film layer being copper;

means for polishing at least the uppermost film layer;

means for examining at least a portion of one or more film layers underlying the uppermost film layer for delamination as the uppermost film layer is being polished; and means for determining whether to suspend the polishing process according to data generated from at least the underlying film layer.

* * * * *